US008653759B2

(12) United States Patent
Vigh et al.

(10) Patent No.: US 8,653,759 B2
(45) Date of Patent: Feb. 18, 2014

(54) LIGHTING SYSTEM ELECTRONIC BALLAST OR DRIVER WITH SHUNT CONTROL FOR LIGHTING CONTROL QUIESCENT CURRENT

(75) Inventors: Peter Vigh, Budapest (HU); Mate Krejcarek, Budapest (HU); Gabor Schmidt, Budapest (HU); Jacint Gergely, Budapest (HU)

(73) Assignee: General Electric Company, Schenectady, NY (US)

( * ) Notice: Subject to any disclaimer, the term of this patent is extended or adjusted under 35 U.S.C. 154(b) by 635 days.

(21) Appl. No.: 12/915,759

(22) Filed: Oct. 29, 2010

(65) Prior Publication Data

US 2012/0104975 A1 May 3, 2012

(51) Int. Cl.
*H05B 37/02* (2006.01)

(52) U.S. Cl.
USPC ..... 315/310; 315/306; 315/119; 315/123

(58) Field of Classification Search
USPC ..... 315/225, 224, 276, 282, 291, 307, 362, 315/312, 46–48, 74–75, 119, 123, 125, 207, 315/306, 310; 363/80, 89, 97, 124, 126
See application file for complete search history.

(56) References Cited

U.S. PATENT DOCUMENTS

| | | | | |
|---|---|---|---|---|
| 6,794,830 | B2 | 9/2004 | Lansing et al. | |
| 2003/0146716 | A1 | 8/2003 | Crouse et al. | |
| 2005/0023997 | A1 | 2/2005 | Chitta | |
| 2006/0197471 | A1 | 9/2006 | Chitta | |
| 2007/0152604 | A1 * | 7/2007 | Tatsumi | 315/247 |
| 2007/0182338 | A1 | 8/2007 | Shteynberg et al. | |
| 2008/0048584 | A1 | 2/2008 | Chitta | |
| 2008/0315783 | A1 * | 12/2008 | Inaba | 315/247 |
| 2009/0160358 | A1 | 6/2009 | Leiderman | |
| 2010/0164406 | A1 | 7/2010 | Kost et al. | |
| 2011/0068701 | A1 * | 3/2011 | van de Ven et al. | 315/185 R |

FOREIGN PATENT DOCUMENTS

| | | | |
|---|---|---|---|
| GB | 2435724 | A | 9/2007 |
| WO | 2009090543 | A2 | 7/2009 |

OTHER PUBLICATIONS

PCT Search Report and Written Opinion dated May 11, 2012 from corresponding Application No. PCT/US2011/051479.

* cited by examiner

*Primary Examiner* — Jerome Jackson, Jr.
*Assistant Examiner* — Borna Alaeddini
(74) *Attorney, Agent, or Firm* — Fay Sharpe LLP

(57) ABSTRACT

Ballasts and LED drivers are presented for powering at least one light source, in which a shunt circuit provides a high impedance to allow operation of the light source when the AC input power exceeds a power threshold value, and provides a low impedance when the AC input power is below the power threshold value to prevent an output power stage from providing power to the light source.

22 Claims, 6 Drawing Sheets

LIGHTING SYSTEM ELECTRONIC BALLAST OR DRIVER WITH SHUNT CONTROL FOR LIGHTING CONTROL QUIESCENT CURRENT

BACKGROUND OF THE DISCLOSURE

The disclosure relates to lighting systems and more particularly to light source drivers or ballasts for powering LED arrays, fluorescent or high-intensity-discharge (HID) lamps. Many lighting system installations include a user-operated control unit, such as a wall-mounted switch or dimmer control, allowing controlled operation of a light source that is mounted remotely from the control device. Some light source control devices incorporate a variety of advanced features, including the ability to receive and act on control information transmitted to the device, such as from a radio frequency (RF) transmitter to allow a user to set the lights on or off or to a specific dimming level without being near the control unit. The control unit, moreover, may perform profile control for selectively turning lights on or off at certain times in a given day, or may perform lighting control operations based on sensed conditions such as ambient light levels and/or the sensed presence or absence of a person or vehicle in a given area near the light. Such advanced control devices (switch, dimmer) often include microprocessors and other circuitry that must be powered independently of when the lights are on, and thus require a certain amount of quiescent current flow from which to derive the off-state power. However, current flowing across the light source during such an off-state can cause abnormal operation (e.g. flashing or flickering) of the lamp or LED array. Prior attempts to address these problems involved dissipating excess off-state power in a resistive component in series with the control unit and parallel with the light source, but this approach reduces energy efficiency. Thus, there is a need for improved lighting systems to avoid inadvertent off-state flashing while providing quiescent off-state current to power advanced lighting control devices.

SUMMARY OF THE DISCLOSURE

The present disclosure provides ballasts and driver circuitry with shunt circuits to selectively provide a bypass current path for quiescent current in the lamp or LED array off-state, while avoiding excess current dissipation in the on-state (including dimmed levels).

A ballast or driver is disclosed, having an input receiving AC input power, a rectifier converting the input power to provide a DC bus output, a DC bus capacitance, an output stage with one or more power converter circuits for powering a light source, and a shunt circuit. The shunt circuit includes first and second shunt circuit nodes coupled between the AC input and the DC bus capacitance. In certain embodiments, an LED driver is provided, where the output power stage includes a DC to DC converter circuit operatively coupled with the rectifier output terminals to convert the rectifier DC output power to provide DC driver output power to at least one LED light source. In other embodiments, a fluorescent lamp ballast is provided, with an output power stage including an inverter providing AC output power to at least one fluorescent light source.

In certain embodiments, the shunt circuit is connected between the rectifier output terminals and the DC bus capacitance. In other embodiments, the shunt circuit is coupled between the ballast or driver input and the rectifier.

The shunt circuit provides a high impedance when the AC input power is greater than or equal to a power threshold value, and provides a low impedance when the input power is below the power threshold value.

In certain embodiments, the power threshold is less than a normal operating power range for powering the light source and the power threshold is greater than an OFF-state quiescent power level of a light source control device coupled between an AC source and the ballast or driver. The disclosed configurations may be advantageously employed to allow quiescent current flow in the ballast or driver while inhibiting charging of the bus capacitance and thus prevent the output power stage from providing power to the light source to preventing or mitigating flickering or flashing in an OFF state when power is not to be delivered to the light source.

In certain embodiments, an active shunt circuit is provided, including a variable impedance circuit having a transistor coupled between the first and second shunt circuit nodes and a control terminal coupled to a sensing circuit including a zener diode and a resistance coupled between the first shunt circuit node and the control terminal to change the transistor impedance according to the voltage across the shunt circuit nodes.

In certain embodiments, a passive shunt circuit is provided, including a positive temperature coefficient (PTC) resistance coupled between the first and second shunt circuit nodes.

BRIEF DESCRIPTION OF THE DRAWINGS

One or more exemplary embodiments are set forth in the following detailed description and the drawings, in which.

DETAILED DESCRIPTION OF THE PREFERRED EMBODIMENTS

Figure 1:
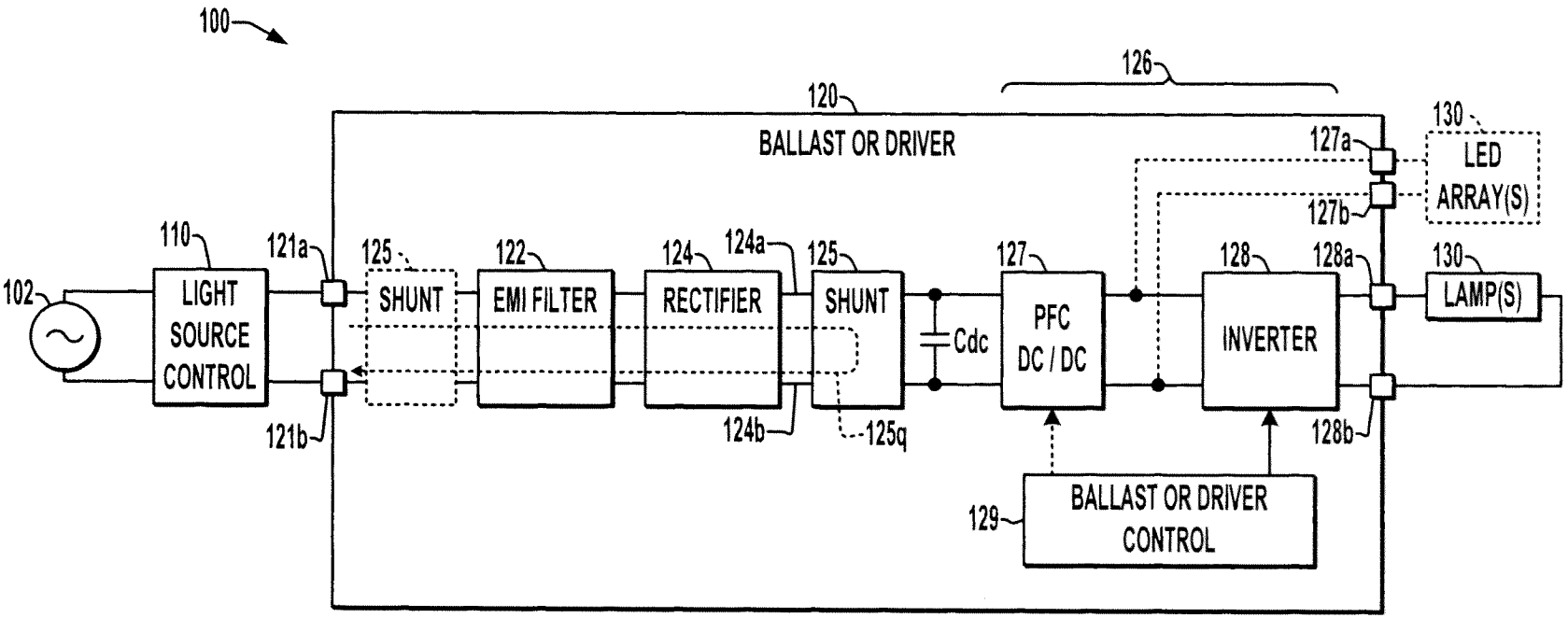
FIG. 1 is a schematic diagram illustrating an exemplary lighting ballast or driver having a shunt circuit between an AC input and a DC bus capacitor in accordance with one or more aspects of the disclosure.

Referring now to the drawings, where like reference numerals are used to refer to like elements throughout, and wherein the various features are not necessarily drawn to scale. The present disclosure relates to ballasts and/or LED drivers for providing power to one or more sources, including a shunt circuit with a variable impedance to allow operation of the light source when the AC input power exceeds a power threshold value, and to provide a low impedance current path upstream of the power output stage when the AC input power is below the power threshold value to prevent an output power stage from providing power to the light source.

FIG. 1 illustrates an exemplary lighting system 100 including an AC power source 102 coupled with a ballast or driver 120 through a light source control device 110, such as a dimmer or switch. The ballast or driver 120 is operable according to power provided from the source 102 to drive one or more light sources 130, such as LED array(s), fluorescent lamps, HID lamps, etc. The exemplary ballast or driver 120 is equipped with a main power conversion system as well as a ballast or driver controller 129, where the power system is operatively coupled with the AC source and the control device 110 via a ballast or driver input 121 with first and second ballast or driver input terminals 121*a* and 121*b* for receiving AC input power. In certain embodiments, an EMI filter 122 is coupled to the input 121, although not a strict requirement of the disclosure. A rectifier circuit 124 is coupled with the input 121 (e.g., through the EMI filter 122 in the illustrated example) and includes one or more passive or active rectifiers (e.g., diodes) to convert the AC input power to provide rectifier DC output power at rectifier output terminals 124*a* and 124*b*. The ballast or driver 120 further includes an output power stage 126 having one or more power conversion circuits 127, 128 operatively coupled with the rectifier output terminals 124*a* and 124*b* to convert the rectifier DC output power to provide ballast or driver output power to the light source(s) 130. A DC bus capacitance Cdc is coupled between the output of the rectifier 124 and the output power stage 126.

In certain embodiments, the apparatus 120 is an LED driver, with the output power stage 126 having a DC to DC converter circuit 127 coupled with the rectifier output terminals 124*a* and 124*b* to convert the rectifier DC output power to provide DC driver output power to at least one LED light source 130 via terminals 127*a* and 127*b*. In other embodiments, the apparatus 120 is a fluorescent lamp ballast, where the output power stage 126 includes a DC to DC converter 127 as well as an inverter 128 providing AC output power to one or more fluorescent light sources 130 via output terminals 128*a* and 128*b*. The DC to DC converter 127 may be omitted in certain ballast implementations, with the inverter 128 directly converting the output of the rectifier 124 to provide AC output power to the light source(s) 130. Where included, moreover, the DC-DC converter 127 may implement power factor correction to control a power factor of the ballast or driver 120, or power factor correction may be done in an active rectifier 124. In both situations, a controller 129 is provided to regulate the output power by controlling one or both of the DC to DC converter 127 and/or the inverter 128.

Some light source control units 110 include circuitry for sensing ambient light, detecting presence or absence of persons or vehicles, RF transceivers, and microprocessors or logic circuitry that require quiescent current flow across the ballast or driver 120 from the AC Mains source 102 for their proper operation, even in an OFF state in which power is not to be delivered to the light source 130. The control device 110 thus has an ON state in which power is delivered to the light source 130 and an OFF state in which a non-zero quiescent current is provided to the ballast or driver 120.

The exemplary ballast or driver 120 accommodates this situation via a shunt circuit 125 to provide a conduction path for such quiescent current flow upstream of the bus capacitance Cdc of the driver or ballast 120 so as to prevent the output power stage from providing power to the light source 130, and to thereby prevent or mitigate flickering or flashing of the light source 130 when the control device 110 is in an OFF state. The shunt circuit 125 senses or otherwise reacts to the ON or OFF state of the control unit 110, and during off-state, limits the voltage of the DC bus capacitor Cdc, thereby preventing undesired starting of the light source 130. When the control unit 110 changes to the ON state, the shunt circuit 125 provides a high impedance to allow the DC bus capacitor Cdc to charge and thus enables provision of power by the output stage 126 to the light source 130, without adversely impacting the ballast or driver power efficiency and the light output efficacy. The disclosed usage of the shunt circuitry 125 thus provides a solution to the above mentioned flashing problems with low power consumption to aid the proper operation of the light source control unit 110 in the ON and OFF states, and provides better lamp efficacy than prior solutions and better compatibility with control units 110 while meeting formal regulations.

As shown in FIG. 1, a shunt circuit 125 may be provided in various locations upstream of the DC bus capacitance Cdc, i.e., between the ballast or driver input 121 and the DC bus capacitance Cdc. In certain exemplary embodiments, an active or passive shunt circuit 125 is coupled between the output of the rectifier 124 and the bus capacitance Cdc (as further detailed in FIGS. 2A, 2B and 3 below), providing an OFF state conductive path 125*p* for conducting quiescent current in the ballast or driver 120 to accommodate quiescent power for an OFF state of certain control devices 110. In other embodiments (e.g., as shown in dashed lines in FIG. 1 and seen in FIG. 4 below), a passive shunt circuit 125 can be coupled between the input 121 and the rectifier 125. In other embodiments, Referring also to FIGS. 2A-4, the ballast or driver 120 is coupled to the AC power source 102 via an intelligent light source control device 110, including an on/off control circuit 112 that may, but need not, implement phase cut dimming control to selectively cut portions of the input AC sinusoidal waveform provided by the mains source 102. A power circuit 114 derives circuit power from the current flow through the control device 110 to power a microprocessor 116 or other logic circuitry that controls operation of the on/off control circuit 112, and which may receive commands or inputs from a user control circuit 118 that may include one or more buttons, knobs, or other user interface implements and which may include a display or other output means for interfacing with a user. The control device 110 may further include one or more sensors or transceivers (not shown) to implement lighting control functions (e.g., on/off, dimming level control) according to sensed conditions (ambient light levels, presence or absence of persons or vehicles in a given sensed area, etc.) and/or according to lighting control commands received from an external source.

Figure 2A:
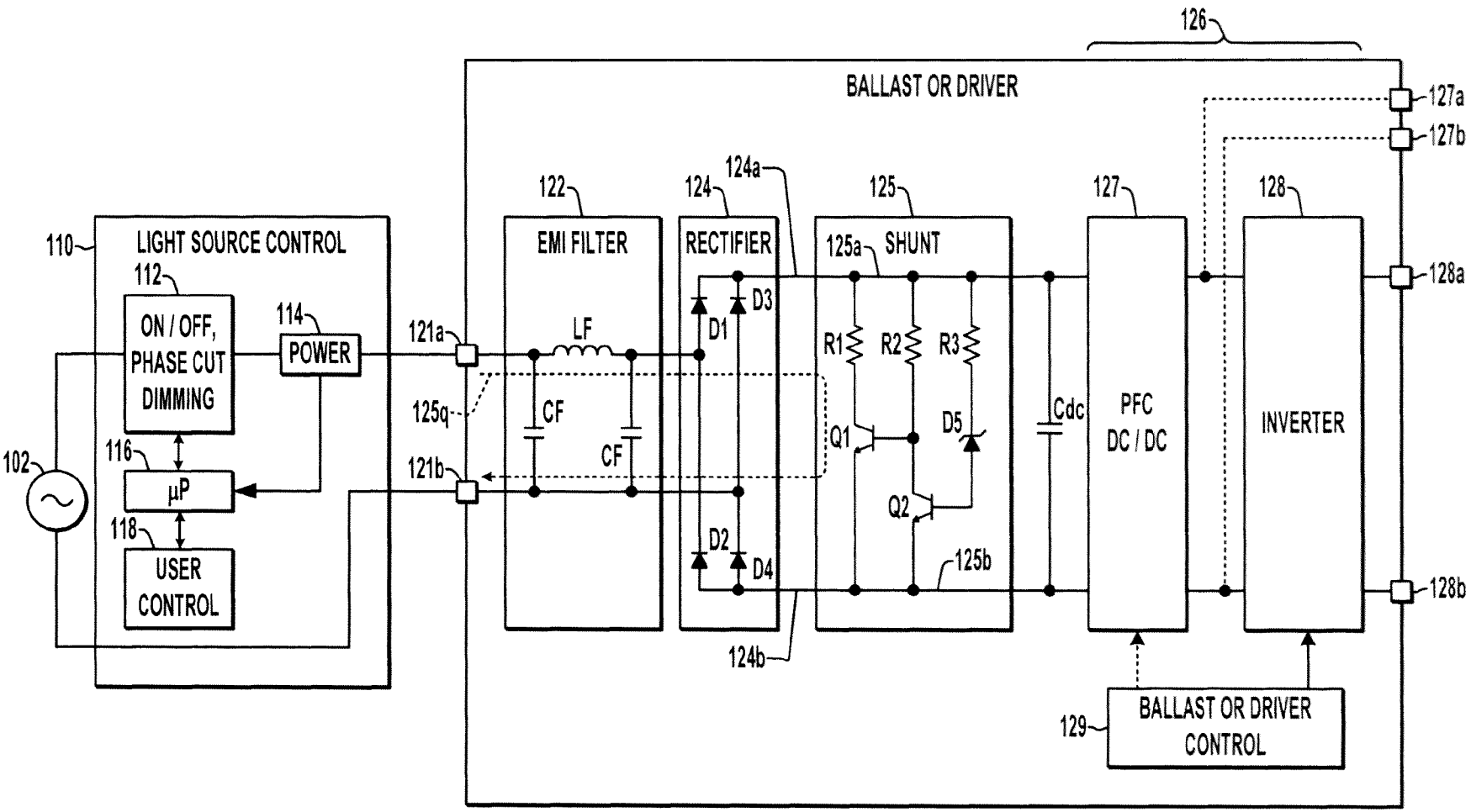
FIGS. 2A and 2B are schematic diagrams illustrating driver or ballast embodiments with an active shunt circuit disposed between the rectifier output and the DC bus capacitor.
Figure 2B:
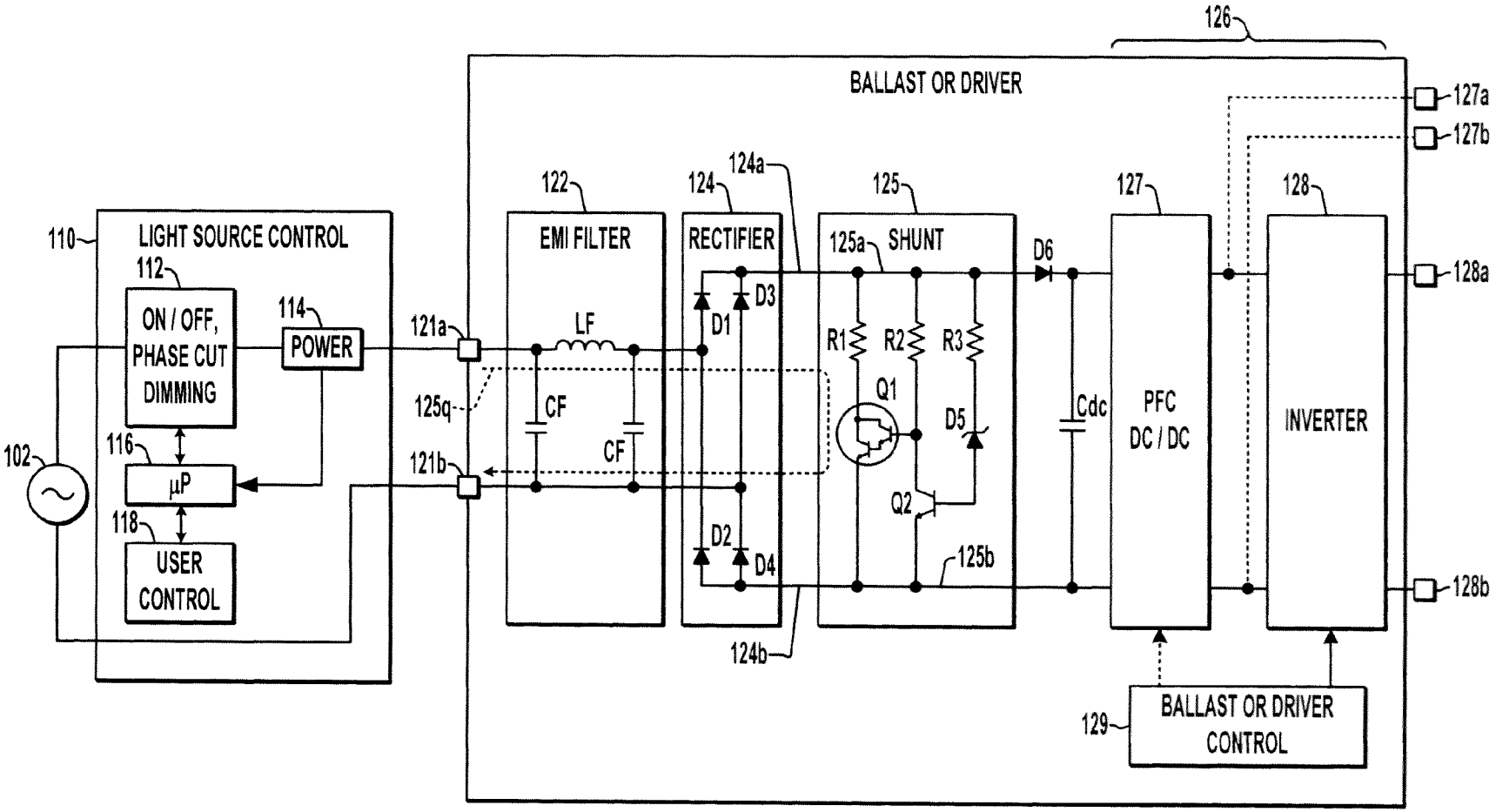

FIGS. 2A and 2B show embodiments in which the shunt circuit 125 includes first and second shunt circuit nodes 125*a* and 125*b*, respectively, coupled between the ballast or driver input 121 and the DC bus capacitance Cdc. In these examples, the EMI filter includes a C-L-C filter circuit with an input parallel capacitance CF, a series inductance LF and a further parallel filter capacitance CF. A passive full bridge rectifier 124 is constructed using diodes D1-D4 forming a rectifier bridge circuit receiving the AC input power through the EMI filter 122 and providing rectifier DC output power at the rectifier output terminals 124*a* and 124*b*.

Figure 5:
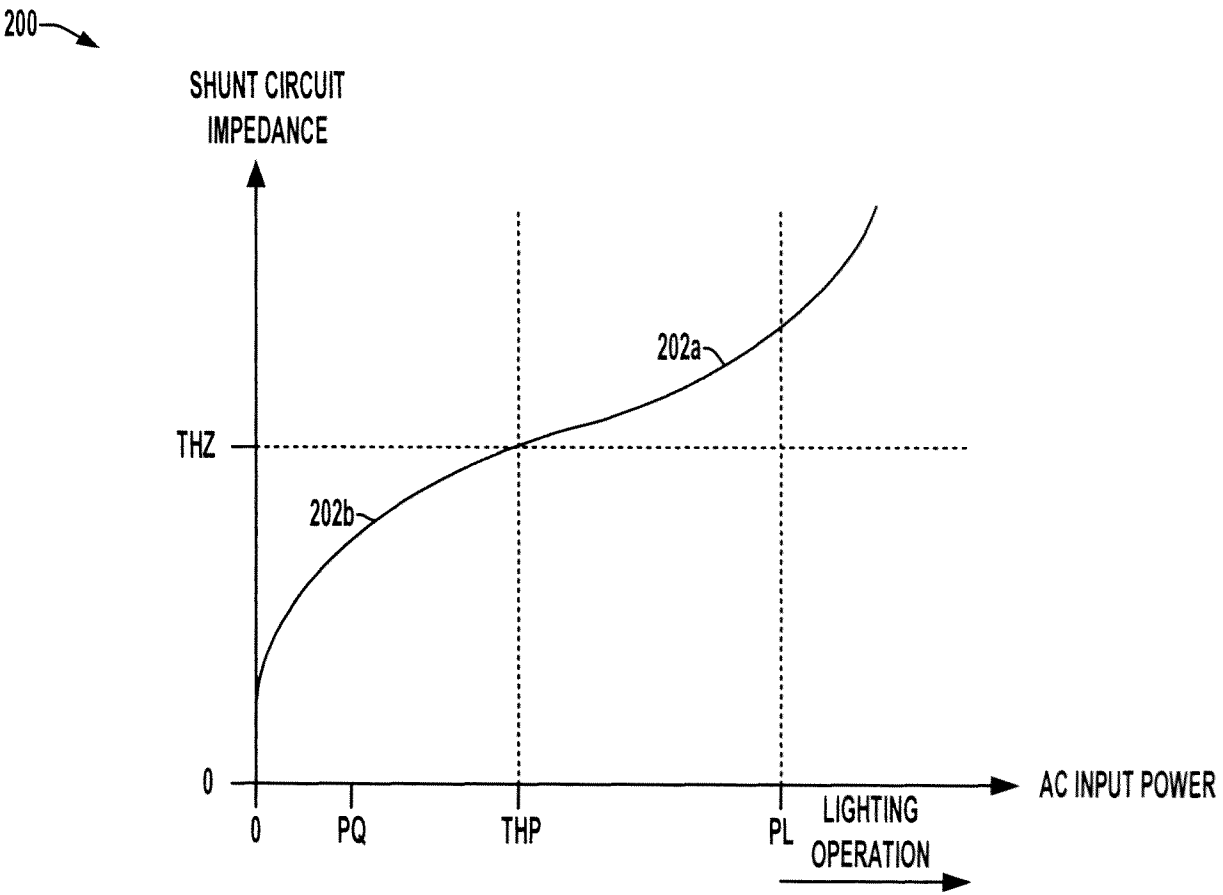
FIG. 5 is a graph illustrating a variable impedance provided by the shunt circuit.

Referring also to FIG. 5, a graph 200 illustrates a variable impedance 202 provided by the shunt circuit 120. The active shunt circuits 125 in FIGS. 2A and 2B receive the output of the rectifier 124 and provide a high impedance 202*a* (FIG. 5) grater than or equal to an impedance threshold THZ between the shunt circuit nodes 125*a* and 125*b* when the AC input power is greater than or equal to a power threshold value THP. In this normal mode of operation (the ON state of the light source control device 110, for either full on or dimming level control operation), the high impedance 202*a* of the shunt circuit 125 does not provide any significant loading to the rectifier output and thus does not adversely affect the energy efficiency of the ballast or driver 120 and does not reduce the light efficacy.

The active shunt circuits 125 of FIGS. 2A and 2B have a variable impedance circuit including NPN transistors Q1 and Q2 and associated resistors R1 and R2, with Q1 having a collector terminal coupled with the first shunt circuit node 125*a* through resistor R1, an emitter terminal coupled with the second shunt circuit node 125*b*, and a base control terminal coupled with node joining the collector of Q2 and the resistor R2. The base of Q2 is coupled to a sensing circuit including a zener diode D5 and a resistance R3 coupled between the first shunt circuit node 125*a* and the base control terminal of Q2 to selectively change the impedance of Q1 based on the DC bus voltage across the first and second shunt circuit nodes 125*a* and 125*b*.

In the normal (ON) state of the control device 110, the rectifier 124 provides a relatively high output DC bus voltage across the shunt circuit nodes 125*a* and 125*b*. In this condition, the DC voltage across the zener diode D5 exceeds the Zener voltage Vz of D5 and D5 conducts, creating a voltage across R3 such that the base emitter voltage of Q2 (Vbe) causes Q2 to turn on. With Q2 on, the collector voltage of Q2 (Vbe of Q1) is brought to ground or near-zero, and thus Q1 turns oft and does not conduct. In one implementation as exemplified in FIG. 2A, Q1 and Q2 can be NPN bipolar transistors such as MMBTA42/PLP (or Q1 can be constructed as two such NPN transistors, or as a Darlington transistor as shown in the embodiment of FIG. 2B) and the zener diode D5 is a BZX84C18V/PLP with a Vz of 18 volts. In the embodiment of FIG. 2A, moreover, R1 is 100 Ω, R2 is 1MΩ, and R3 is 220 kΩ, whereby the conduction in the ON state through the resistors R2 and R3 is small and does not significantly impact the efficiency of the ballast or driver 120, while the AC input power will be at or above the lighting power level PL shown in FIG. 5 to provide full on or dimming level controlled light output from the source(s) 130. In one implementation of the embodiment of FIG. 2B, transistor Q1 is a Darlington MJE13003/TO with R1 being 100 Ω, R2 being 220KΩ, R3 being 100 kΩ, and zener diode D5 being a 68 volt device such as a BZx84C68/PLP. In the embodiment of FIG. 2B, moreover, a further diode D6 is provided in the upper DC bus connection between the shunt circuit 125 and the DC capacitance Cdc.

When the control device 110 is placed into an OFF mode or state, power is not to be provided to the light source(s) 130. In this condition, the input power to the ballast or driver 120 is below the power threshold THP and the shunt circuit 125 provides a low impedance 202*b* (FIG. 5) below the impedance threshold THZ between the shunt circuit nodes 125*a* and 125*b*. In this situation, the DC bus voltage across the shunt circuit nodes 125*a* and 125*b* is non-zero, but low enough that the voltage across D5 is less than its Vz (e.g., below 18 volts in the example of FIG. 2A), and thus Q2 remains off. In this condition, the Vbe of Q1 is high enough to turn Q1 on, and thus the quiescent current from the control device 110 can flow through the path 125*q* (shown in dashed line in FIG. 2) through the resistance R1 and through Q1, which provides an impedance less than the impedance threshold THZ of FIG. 5. It is noted that this quiescent current path is upstream of the DC bus capacitance Cdc, and thus Cdc preferably does not charge at all or in any event not enough to activate the power output stage 126. Thus, the shunt circuit 125 provides the path 125*q* for quiescent current while preventing the provision of power to the light source(s) 130, thereby mitigating flashing or flickering when the AC input power is below the power threshold value THP. In this regard, the power threshold value THP is less than a normal operating power range for powering the light source(s) 130 and the power threshold value THP in this embodiment is greater than an OFF-state quiescent power level PQ (FIG. 5) of the light source control device 110 coupled between the AC source 102 and the ballast or driver 120.

Figure 3:
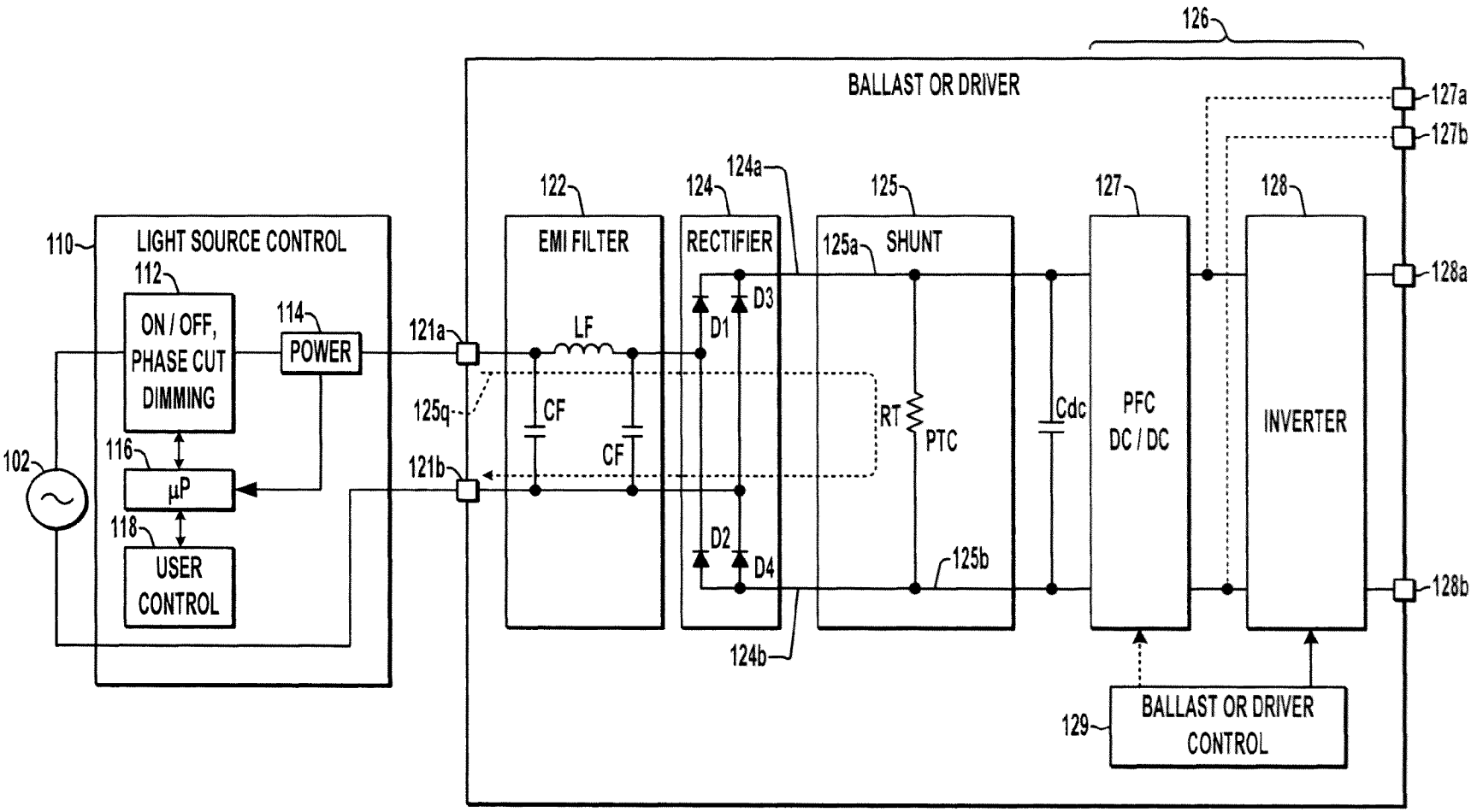
FIG. 3 is a schematic diagram illustrating an embodiment with a passive shunt circuit coupled between the rectifier output and the DC bus capacitor.

FIG. 3 shows another embodiment with a passive shunt circuit 125 coupled between the rectifier output terminals 124*a*, 124*b* and the DC bus capacitor Cdc. In this embodiment, the passive shunt circuit 125 includes a positive temperature coefficient (PTC) resistance RT coupled between the first and second shunt circuit nodes 125*a* and 125*b*. In the normal (ON) state of the control device 110, the PTC resistance RT heats up and becomes high impedance, with the rectifier output thereafter being primarily loaded by the DC bus capacitance Cdc, which in turn allows provision of power from the output stage 126 to the light source(s) 130. When the control device 110 changes to the OFF state, the DC bus voltage drops, allowing the resistance RT to cool and become a low impedance. In this condition, the PTC RT provides a conduction path 125*q* for quiescent current flow from the control device 110, and prevents significant charging of the capacitance Cdc.

Figure 4:
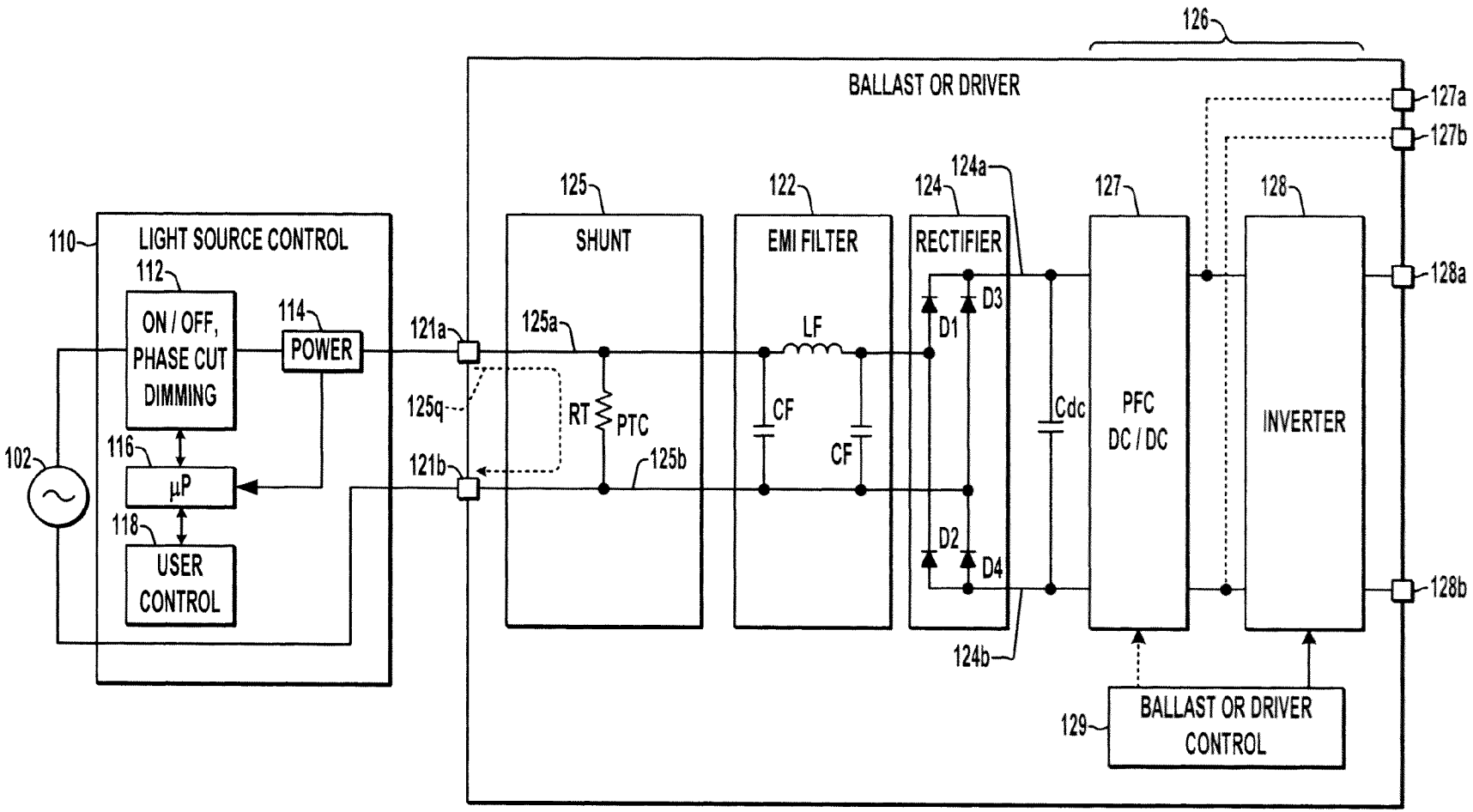
FIG. 4 is a schematic diagram illustrating an embodiment with a passive shunt circuit coupled between the AC input and the rectifier.

Another embodiment is shown in FIG. 4, in which the nodes 125*a* and 125*b* of the passive shunt circuit 125 are coupled between the ballast or driver input 121 and the rectifier 125. In this regard, the PTC resistance RT provides similar selective impedance control for the AC power received by the rectifier 124. In the ON state of the control device 110, the PTC resistance RT heats up and becomes high impedance, and thus does not adversely impact the operation of the rectifier or the power output stage 126. In this condition, therefore, power is provided from the output stage 126 to the light source(s) 130 for normal operation (full on or dimming control). In the OFF state of the control device 110, the PTC device RT remains relatively cool and thus provides a low impedance conductive path 125*q* for the quiescent current from the control device 110. In this condition, the rectifier output is insufficient to significantly charge the capacitance Cdc, and the power output stage 126 remains off to prevent flicker or flashing of the light source(s) 130.

The above examples are merely illustrative of several possible embodiments of various aspects of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, processor-executed software, or combinations thereof, which performs the specified function of the described component (i.e., that is functionally equivalent), even though not structurally equivalent to the disclosed structure which performs the function in the illustrated implementations of the disclosure. In addition, although a particular feature of the disclosure may have been illustrated and/or described with respect to only one of several implementations, such feature may be combined with one or more other features of the other implementations as may be desired and advantageous for any given or particular application. Furthermore, references to singular components or items are intended, unless otherwise specified, to encompass two or more such components or items. Also, to the extent that the terms "including", "includes", "having", "has", "with", or variants thereof are used in the detailed description and/or in the claims, such terms are intended to be inclusive in a manner similar to the term "comprising". The invention has been described with reference to the preferred embodiments. Obviously, modifications and alterations will occur to others upon reading and understanding the preceding detailed description. It is intended that the invention be construed as including all such modifications and alterations.

The following is claimed:

1. A ballast or driver for powering at least one light source, comprising:

a ballast or driver input with first and second ballast or driver input terminals for receiving AC input power;

a rectifier circuit operatively coupled with the ballast or driver input to convert the AC input power to provide rectifier DC output power at first and second rectifier output terminals;

an output power stage comprising at least one power conversion circuit operatively coupled with the rectifier output terminals to convert the rectifier DC output power to provide ballast or driver output power to the at least one light source;

a DC bus capacitance coupled between the rectifier and the output power stage; and a shunt circuit comprising first and second shunt circuit nodes coupled between the ballast or driver input and the DC bus capacitance, the shunt circuit being operative to provide a high impedance greater than or equal to an impedance threshold between the shunt circuit nodes when the AC input power is greater than or equal to a power threshold value, and to provide a low impedance below the impedance threshold between the shunt circuit nodes when the AC input power is below the power threshold value.

2. The ballast or driver of claim 1, where the low impedance of the shunt circuit limits a voltage of the DC bus capacitance to prevent the output power stage from providing ballast or driver output power to the at least one light source when the AC input power is below the power threshold value.

3. The ballast or driver of claim 2, where the shunt circuit nodes are coupled between the rectifier output terminals and the DC bus capacitance.

4. The ballast or driver of claim 2, where the shunt circuit nodes are coupled between the ballast or driver input and the rectifier.

5. A ballast or driver for powering at least one light source, comprising:

a ballast or driver input with first and second ballast or driver input terminals for receiving AC input power;

a rectifier circuit operatively coupled with the ballast or driver input to convert the AC input power to provide rectifier DC output power at first and second rectifier output terminals:

an output power stage comprising at least one power conversion circuit operatively coupled with the rectifier output terminals to convert the rectifier DC output power to provide ballast or driver output power to the at least one light source;

a DC bus capacitance coupled between the rectifier and the output power stage; and a shunt circuit comprising first and second shunt circuit nodes coupled between the ballast or driver input and the DC bus capacitance, the shunt circuit being operative to provide a high impedance greater than or equal to an impedance threshold between the shunt circuit nodes when the AC input power is greater than or equal to a power threshold value, and to provide a low impedance below the impedance threshold between the shunt circuit nodes when the AC input power is below the power threshold value;

where the power threshold value is less than a normal operating power range for powering the at least one light source and where the power threshold value is greater than an OFF-state quiescent power level of a light source control device coupled between an AC source and the ballast or driver.

6. The ballast or driver of claim 1, where the shunt circuit nodes are coupled between the rectifier output terminals and the DC bus capacitance.

7. The ballast or driver of claim 6, where the shunt circuit is an active circuit comprising:

a variable impedance circuit including at least one transistor with a first terminal coupled with the first shunt circuit node, a second terminal coupled with the second shunt circuit node, and a control terminal; and a sensing circuit including a zener diode and a resistance coupled between the first shunt circuit node and the control terminal to selectively change the impedance of the at least one transistor based on a voltage across the first and second shunt circuit nodes.

8. The ballast or driver of claim 1, where the shunt circuit nodes are coupled between the ballast or driver input and the rectifier.

9. A ballast or driver for powering at least one light source, comprising:

a ballast or driver input with first and second ballast or driver input terminals for receiving AC input power;

a rectifier circuit operatively coupled with the ballast or driver input to convert the AC input power to provide rectifier DC output power at first and second rectifier output terminals:

an output power stage comprising at least one power conversion circuit operatively coupled with the rectifier output terminals to convert the rectifier DC output power to provide ballast or driver output power to the at least one light source;

a DC bus capacitance coupled between the rectifier and the output power stage; and a shunt circuit comprising first and second shunt circuit nodes coupled between the ballast or driver input and the DC bus capacitance, the shunt circuit being operative to provide a high impedance greater than or equal to an impedance threshold between the shunt circuit nodes when the AC input power is greater than or equal to a power threshold value, and to provide a low impedance below the impedance threshold between the shunt circuit nodes when the AC input power is below the power threshold value;

where the shunt circuit is an active circuit comprising:

a variable impedance circuit including at least one transistor with a first terminal coupled with the first shunt circuit node, a second terminal coupled with the second shunt circuit node, and a control terminal, and a sensing circuit including a zener diode and a resistance coupled between the first shunt circuit node and the control terminal to selectively change the impedance of the at least one transistor based on a voltage across the first and second shunt circuit nodes.

10. The ballast or driver of claim 1, where the shunt circuit is a positive temperature coefficient (PTC) resistance coupled between the first and second shunt circuit nodes.

11. The ballast or driver of claim 1, being an LED driver, where the output power stage comprises a DC to DC converter circuit operatively coupled with the rectifier output terminals to convert the rectifier DC output power to provide DC driver output power to at least one LED light source.

12. The ballast or driver of claim 1, being a fluorescent lamp ballast, where the output power stage comprises an inverter providing AC output power to at least one fluorescent light source.

13. The ballast or driver of claim 1, where the shunt circuit nodes are coupled between the rectifier output terminals and the DC bus capacitance, further comprising a diode coupled in series between the first shunt circuit node and the DC bus capacitance.

14. The ballast or driver of claim 5, where the low impedance of the shunt circuit limits a voltage of the DC bus capacitance to prevent the output power stage from providing ballast or driver output power to the at least one light source when the AC input power is below the power threshold value.

15. The ballast or driver of claim 5, where the shunt circuit nodes are coupled between the rectifier output terminals and the DC bus capacitance.

16. The ballast or driver of claim 5, where the shunt circuit is an active circuit comprising:

a variable impedance circuit including at least one transistor with a first terminal coupled with the first shunt circuit node, a second terminal coupled with the second shunt circuit node, and a control terminal; and a sensing circuit including a zener diode and a resistance coupled between the first shunt circuit node and the control terminal to selectively change the impedance of the at least one transistor based on a voltage across the first and second shunt circuit nodes.

17. The ballast or driver of claim 5, where the shunt circuit is a positive temperature coefficient (PTC) resistance coupled between the first and second shunt circuit nodes.

18. The ballast or driver of claim 5, where the shunt circuit nodes are coupled between the ballast or driver input and the rectifier.

19. The ballast or driver of claim 9, where the low impedance of the shunt circuit limits a voltage of the DC bus capacitance to prevent the output power stage from providing ballast or driver output power to the at least one light source when the AC input power is below the power threshold value.

20. The ballast or driver of claim 9, where the shunt circuit nodes are coupled between the rectifier output terminals and the DC bus capacitance.

21. The ballast or driver of claim 9, where the shunt circuit is a positive temperature coefficient (PTC) resistance coupled between the first and second shunt circuit nodes.

22. The ballast or driver of claim 9, where the shunt circuit nodes are coupled between the ballast or driver input and the rectifier.

* * * * *